United States Patent [19]

Fink et al.

[11] 4,402,255

[45] Sep. 6, 1983

[54] COMPRESSED-AIR VIBRATOR WITH RECIPROCATING PISTON

[75] Inventors: Willy Fink, Girsbergstrasse, 8479 Waltalingen, Switzerland; Alex Fehr, Henggart, Switzerland

[73] Assignee: Willy Fink, Switzerland

[21] Appl. No.: 207,939

[22] Filed: Nov. 18, 1980

[30] Foreign Application Priority Data

Nov. 20, 1979 [CH] Switzerland ..... 10344/79

[51] Int. Cl.[3] ..... F01L 21/02

[52] U.S. Cl. ..... 91/234; 92/169; 92/161

[58] Field of Search ..... 91/234; 175/19; 92/169

[56] References Cited

U.S. PATENT DOCUMENTS

| | | | |
|---|---|---|---|
| 1,807,839 | 6/1931 | Garlin | 91/234 |
| 1,872,403 | 8/1932 | Cannon | 91/234 |
| 2,781,742 | 2/1957 | Poole | 91/234 |
| 2,872,902 | 2/1959 | Morgan | 91/234 |
| 3,040,710 | 6/1962 | Wilder | 91/234 |

FOREIGN PATENT DOCUMENTS

| | | |
|---|---|---|
| 712352 | 3/1952 | United Kingdom . |
| 1113181 | 3/1967 | United Kingdom . |
| 2020746 | 5/1979 | United Kingdom . |

*Primary Examiner*—Paul E. Maslousky

*Attorney, Agent, or Firm*—Scully, Scott, Murphy & Presser

[57] ABSTRACT

A compressed-air vibrator with a cylindrical housing confined between closure covers, within which there is arranged a piston reciprocated by the compressed air, whereby the compressed air is alternatingly introduced into the two working chambers through a central inlet groove in the cylinder bore and through axial bores which discharge through the end surfaces of the piston, and wherein the air is conveyed out of the chambers through outlets which are controlled by the piston edges.

7 Claims, 3 Drawing Figures

COMPRESSED-AIR VIBRATOR WITH RECIPROCATING PISTON

BACKGROUND OF THE INVENTION

1. Field of the Invention

The present invention relates to a compressed-air vibrator with a cylindrical housing confined between closure covers, within which there is arranged a piston reciprocated by the compressed air, whereby the compressed air is alternatingly introduced into the two working chambers through a central inlet groove in the cylinder bore and through axial bores which discharge through the end surfaces of the piston, and wherein the air is conveyed out of the chambers through outlets which are controlled by the piston edges.

2. Discussion of the Prior Art

Compressed-air vibrators of this type have become known in the form of various embodiments. Mostly they evidence a complicated construction and, in addition, neccessitate an expensive pressurized oil lubrication which is undesirable for various purposes of application. From German Published Patent Application No. 23 41 219 there has also become known a compressed-air vibrator which operates without an auxiliary pressurized oil lubrication. The cylinder is assembled from inner and outer sleeves which are threaded together, wherein annular grooves are provided intermediate the inner and outer sleeves for the outflowing compressed air, and which serve for cooling. The construction of these apparatuses is extremely complicated and their manufacture requires large demands and is expensive.

The compressed-air vibrators of the above-mentioned type further have the property that, in the horizontal position, the piston will hunt precisely in the center of the hollow cylinder when the compressed air infeed is shut off. When compressed air is again conveyed into the apparatus in this neutral piston position it is not possible to effect a restart due to the closed off inlet bore. The previously known piston-type vibrators accordingly, are equipped with (a) built-in springs which press the piston towards one side, or (b) with an auxiliary valve control, or (c) with fine starting grooves on the piston, which measures facilitate restarting even in the horizontal position of the apparatus. The negative aspects of these three methods are: (a) fracture of the spring and therewith connected possible destruction of the apparatus, (b) the valve control is expensive in construction and in its assembly at the working site, (c) the possibility of the plugging up of the starting grooves through dirt particles contained in the compresed air, the leakage losses during operation.

SUMMARY OF THE INVENTION

Accordingly, it is an object of the present invention to so construct a compressed-air vibrator of the above mentioned type which allows its housing to be simply and inexpensively constructed, which contains an integrated cooling system and an integrated starting aide, as well as the fastening means for the attachment of the apparatuses which are determined therefore whereby the mounting will also be rendered easier.

The foregoing object is inventively achieved through a compressed-air vibrator of the above-mentioned type which has the cylindrical housing constructed as a profiled member in which the central cylinder bore is encompassed by four cross-shape arranged ribs which contain four bores extending in parallel with the axis of the cylindrical bore, of which one inlet bore serves for the inlet and one outlet bore for the withdrawal of the compressed air, and the two other bores are adapted to receive fastening bolts.

The inventive arrangement of the inlet bore and of the outlet bore facilitates the arrangement of the conduits for the inlet and outlet of the compressed air to be at the same end surface of the housing, which renders easier the assembly at the work site. Further, this arrangement facilitates the assembly of the starting aide and the hereinbelow described ribbed conduit which serves for the cooling of the housing and for sound attenuation.

BRIEF DESCRIPTION OF THE DRAWINGS

Reference may now be had to a preferred embodiment of the invention, taken in conjunction with the accompanying drawings; in which.

DETAILED DESCRIPTION

Figure 1:
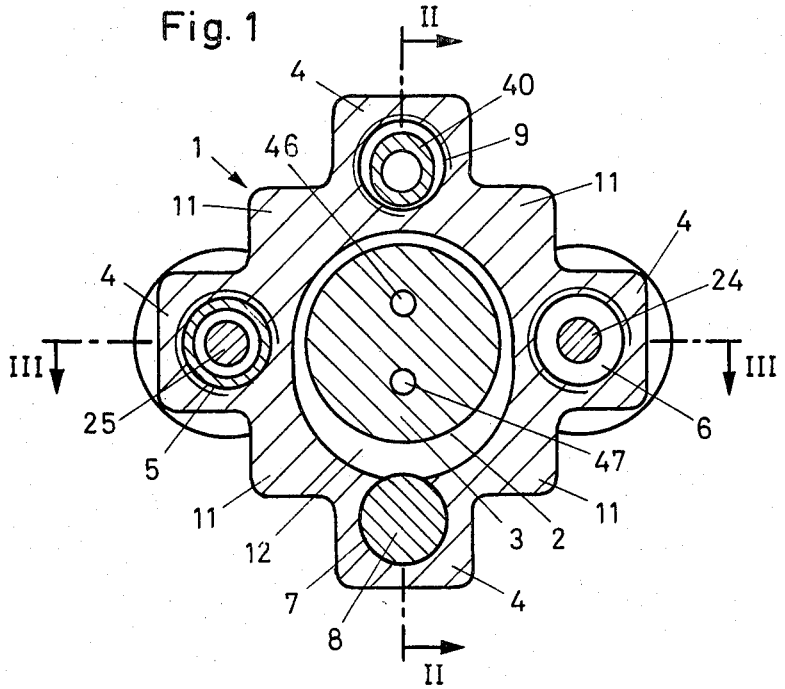
FIG. 1 illustrates a cross-sectional view, taken along line 1—1 in FIG. 2, through a compressed-air vibrator with a hollow cylinder which is located between closure covers, and with a piston reciprocable within this hollow cylinder by means of the compressed air.
Figure 2:
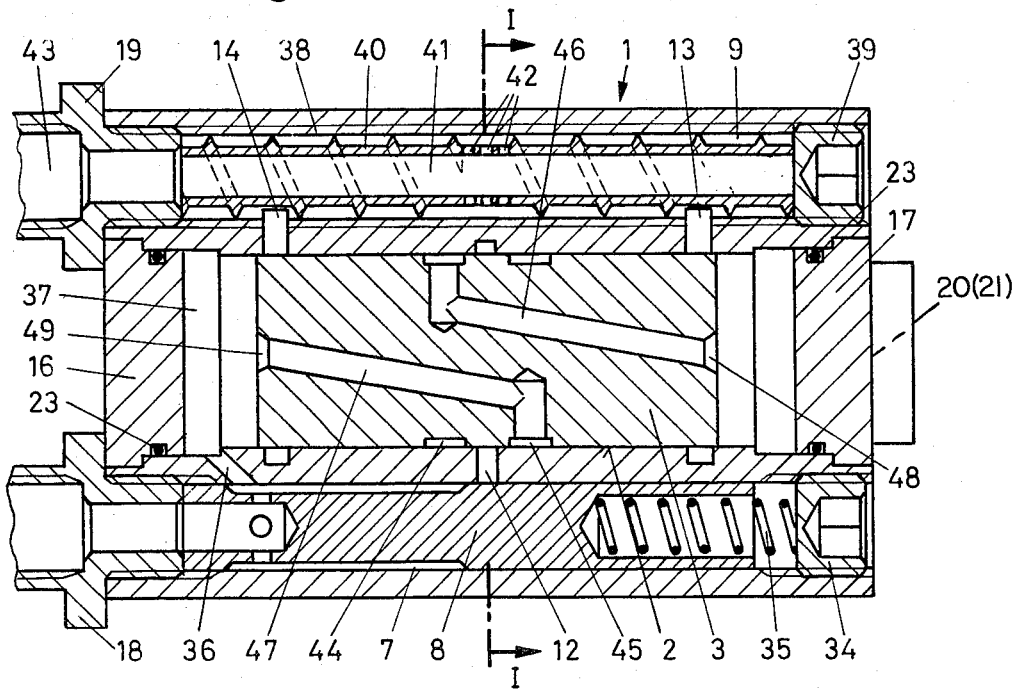
FIG. 2 is a longitudinal sectional view taken along line 2—2 in FIG. 1.

A compressed-air vibrator includes a cylindrical housing 1 which is constructed of a light-weight metal, with a centrally located cylindrical bore 2 for the receipt of the piston 3 and four bores located in cross-positioned ribs 4, of which the bores 5 and 6 serve for the receipt of fastening screws 24 and 25, the third bore 7 serves for the inlet of the compressed air and for the support of a piston-shaped slide valve 8, and the fourth bore 9 serves for the outlet of the air and for the receipt of a cooling labyrinth. Four additional star-shape arranged ribs 11 interspaced between ribs 4 serve for the stiffening of the housing and for a highly operative cooling effect.

The cylinder bore 2 is provided with an eccentrically arranged annular groove 12 in the middle of the housing which extends over into the compressed air inlet bore 7, as well as two eccentric annular grooves 13 and 14 which are located at equal distances from the middle groove 12 and which extend into the outlet bore 9. This arrangement facilitates the inlet and outlet of the compressed air at one end the same end surface.

At the two ends of the housing 1 the cylinder bore 2 is closed off by, respectively, the closure cover 16 and 17. These closure covers are clamped fast in their assembled positions through the flat heads of respectively, two screws 18 and 19 on the one end surface (16), and screws 20 and 21 on the other end surface (17) and, through the intermediary of inserted O-rings 23, are sealed against an undesirable outlet of compressed air.

Figure 3:
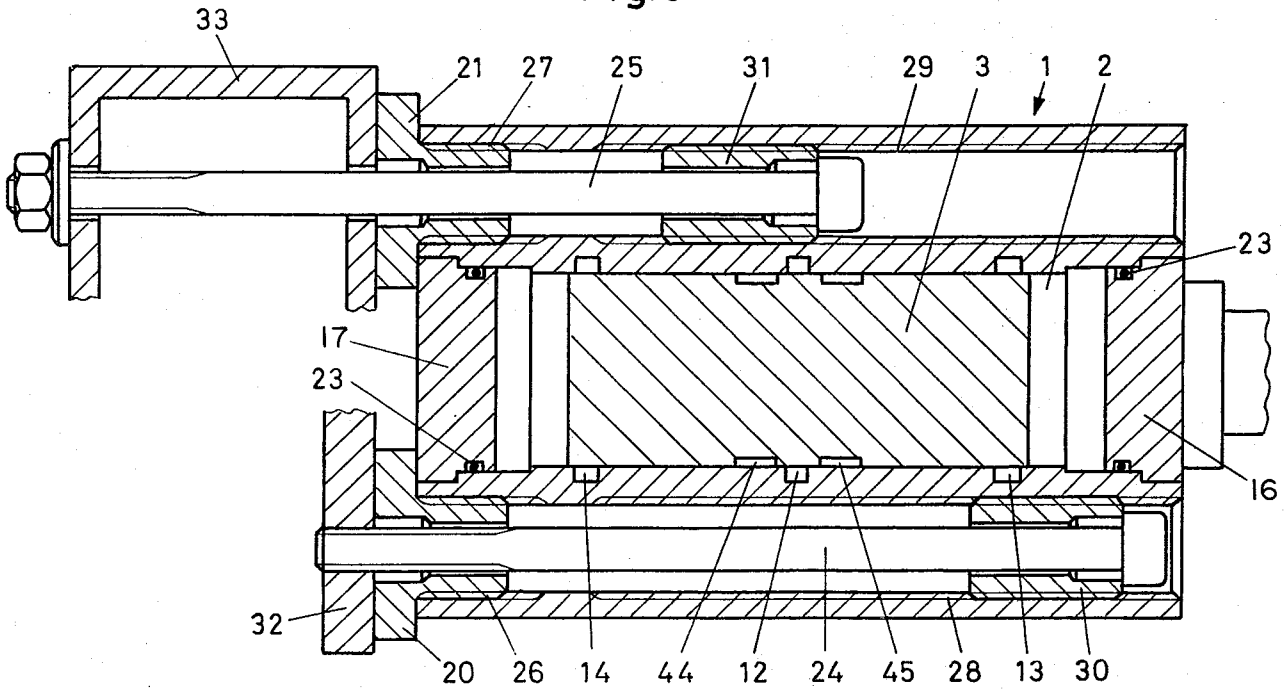
FIG. 3 is a longitudinal sectional view taken along line 3—3 in FIG. 1 wherein there are illustrated different capabilities for assembly.

The two through-bores 5 and 6 provided in the ribs 4 for receiving of the fastening bolts 24 and 25 which evidence, at the one end surface, two short right-handed threads 26 and 27 into which there are threaded screws 20 and 21 which are provided with through-bores, and whose flat heads serve, on the one hand, as contact surfaces for the apparatus and on the other hand, to clamp fast the closure cover 17. On the inlet and outlet side for the compressed air these cores are provided with a long left-handed thread 28 and 29 in which there are arranged threaded sleeves 30 and 31 with through-bores, and which are adjustable in inserted depth. This arrangement facilitates that the apparatus, by means of the two lengthy socket head screws which are delivered therewith as fastening bolts 24, 25, are threaded in the outer position of the threaded sleeve 30 directly onto a plate 32, or in an inner position of the threaded sleeve 31, can be fastened to one more or less wide supports 33 with through-bores from rearwardly by means of nuts (FIG. 3). The sleeves 30 and 31 which are equipped with left-handed threads produce a counter-effect with regard to the fastening bolts 24 and 25 which have right-handed threads which prevents a loosening of the screws through high-frequencied vibrations generated by the apparatus.

The inlet bore 7 which is provided in the third rib for the compressed air is provided at both ends with short threads in which, on one side, there is inserted a closure screw 34 and, on the other side, a screw 18 serving as a connecting nipple for the hose connection. The middle portion of this bore 7 is worked to a precise diameter and serves for the receipt of a piston-shaped slide valve 8 which is compressed against the screw 18 by a spring 35. This slide valve 8 has the task that at a neutral position of the piston 3, at the moment of the entry of the compressed air, the inlet groove 12 of the cylinder bore 2 will be maintained closed. The incoming compressed air is thus initially deflected through an auxiliary bore 36 into the cylinder chamber 7, fills this chamber and pushes the piston 3 in the direction against the cover 17. As soon as the chamber 37 is filled with compressed air, the pressure increases and slides the valve 8 in the direction towards the cover 16 while overcoming the force of the spring 35. In that manner there is closed the auxiliary bore 36 and the through-passage to the inlet groove 12 is opened whereby the piston 3 is set into its alternating motion.

The outlet bore 9 which is located in the fourth rib for the compressed air is provided with a through-extending thread 38 in which, on one side, there is inserted a closure screw 39 and, on the other side, the screw 19 serving as the connecting nipple is threaded in for a sound attenuator (not shown). The middle portion of this bore 9 serves for receiving a tube 40 which is provided with screw-shaped ribs and which has an axial through-bore 41 and a number of smaller connecting apertures 42 between the outer bore 9 and through bore 41 on the support side. This arrangement serves as a labyrinth and renders it impossible that the compressed air which exits from the grooves 13 and 14 will assume a direct path to the outlet opening 43, but leads the air across the hollow space between the bore 9 and the screw-shaped tube 40 through the small connecting apertures 42 into the through-bore 41 to the actual air outlet 43. This arrangement thus fulfills two important tasks: Firstly, the compressed air is conveyed through the screw-shaped tube 40 along the wall of the bore 9 and, due to the adiabetic expansion sequence, is extensively cooled. The surface of the bore 9 which is enlarged by the internal threading 38 thus serves as a cooler for the entire housing 1 since, as is known, the temperature will propegate extremely rapidly in light-weight metal. The primary purpose of this cooling serves to prevent an excessive heating of the cylinder bore 2. Secondly, the high sound level occuring due to the compression which suddenly exits from the grooves 13 and 14 will markedly reduce along the detour through the labyrinth on the exterior of the tube 40 and the small connecting apertures 42.

The piston 3 which reciprocates in the cylinder bore 2 evidences two grooves 44 and 45 at the periphery in which these streams in the compressed air pursuant to the position of the piston 3 over the groove 12. The grooves 44 and 45 are connected by means of the bores 46 and 47 with the presently more remote end surface of the piston 3.

The outlet apertures 48 and 49 for the pressure medium are located precisely in the center of the piston 3, which prevents a one-sided pressure on the piston 3 tending to cause wear thereof.

What is claimed is:

1. In a compressed-air vibrator including a cylinder housing having two longitudinal end surfaces each provided with a closure cover, a piston having two opposing ends each having a circumferential edge, reciprocated by said compressed air being arranged within a cylinder bore which is disposed within said housing; a central inlet groove in said cylinder bore; axial bores extending to the end surfaces of said piston; said compressed air being alternatingly conducted into two work chambers of said cylinder bore through said inlet groove and axial bores; and outlets in said work chambers for said compressed air controlled by the piston edges, the improvement comprising: said cylinder housing being a profiled member including four cross positioned ribs encompassing the central cylinder bore; four bores being arranged one each in said ribs and extending parallel to the axis of said cylinder bore; one said bore being an inlet bore for the infeed of compressed air, one said bore being an outlet bore for said compressed air; and fastening bolts being located in said remaining two bores.

2. Compressed-air vibrator as claimed in claim 1, comprising a piston-shaped slide valve in said inlet bore for the compressed air; a spring forcing said valve into a stationary position for connecting the inlet bore with one of said work chambers through an auxiliary bore and maintaining closed the central inlet groove whereby the valve is displaceable by said compressed air into an operating position against the pressure of said spring in which the inlet bore is connected with the inlet groove and said auxiliary bore is closed.

3. Compressed-air vibrator as claimed in claim 1, comprising a conduit inserted into said air outlet bore; a screw-shaped wound rib being supported on the exterior of said conduit so as to form a labyrinth; and connecting apertures formed in said conduit and leading to the interior thereof.

4. Compressed-air vibrator as claimed in claim 1, said two bores having the fastening bolts therein including a threaded bore; a threaded sleeve being screwed into said threaded bore and having the fastening bolts into the through-bores thereof.

5. Compressed-air vibrator as claimed in claim 1, said axial bores in said piston extending into the centers of the end surfaces thereof.

6. Compressed-air vibrator as claimed in claim 1 comprising hollow screws having flat heads for fastening said closure covers to said housing wherein each hollow screw cooperates with one axial bore by means of screw threads provided in said axial bores, two of said hollow screw heads serving as connector nipples for the compressed air inlet and outlet conduits and two of said hollow screw heads serving as guides for the fastening bolts.

7. Compressed-air vibrator as claimed in claim 1, said cylinder housing being a profiled member formed of a light-weight metal.

* * * * *